US008485849B2

(12) United States Patent
Ahn et al.

(10) Patent No.: US 8,485,849 B2
(45) Date of Patent: Jul. 16, 2013

(54) USB CONNECTOR

(75) Inventors: Hae-Won Ahn, Gyeongsangbuk-do (KR); Jae-Wan Kim, Gyeongsangbuk-do (KR); Dong Hoon Kwak, Gyeongsangbuk-do (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 34 days.

(21) Appl. No.: 13/106,013

(22) Filed: May 12, 2011

(65) Prior Publication Data

US 2011/0281463 A1 Nov. 17, 2011

(30) Foreign Application Priority Data

May 13, 2010 (KR) ..... 10-2010-0045041

(51) Int. Cl.
*H01R 13/648* (2006.01)

(52) U.S. Cl.
USPC ..... 439/607.01

(58) Field of Classification Search
USPC ..... 439/607.01, 607.013, 607.23, 101, 439/79–80
See application file for complete search history.

(56) References Cited

U.S. PATENT DOCUMENTS 7,128,609 B1 * 10/2006 Chen ..... 439/607.53
7,618,268 B2 * 11/2009 Ko et al. ..... 439/101
7,748,997 B2 * 7/2010 Hamner et al. ..... 439/79
7,922,533 B2 * 4/2011 Wang et al. ..... 439/607.23

* cited by examiner

*Primary Examiner* — Jean F Duverne
(74) *Attorney, Agent, or Firm* — Cha & Reiter, LLC

(57) ABSTRACT

A Universal Serial Bus (USB) connector with a connector housing is provided with at least one soldering part and at least one reinforcement part around its circumference. The USB connector includes: a connector housing; one or more soldering parts formed by cutting and unfolding predetermined areas around the circumference of the connector housing; and one or more reinforcement parts, each of which is formed by bending an end of the connector housing. The reinforcement parts being engaged with the soldering parts to support and reinforce the soldering parts, respectively.

14 Claims, 5 Drawing Sheets

USB CONNECTOR

CLAIM OF PRIORITY

This application claims the benefit of priority under 35 U.S.C. §119 from a Korean Patent Application entitled "USB Connector" filed in the Korean Intellectual Property Office on May 13, 2010 and assigned Serial No. 10-2010-0045041, the contents of which are incorporated herein by reference in its entirety.

BACKGROUND OF THE INVENTION

1. Field of the Invention

The present invention relates to a Universal Serial Bus (USB) connector with a connector housing, which is provided with at least one soldering part and at least one reinforcement part around its circumference.

2. Description of the Related Art

Recently, due to the development of communication related technologies, portable communication devices have become widely popular, and various additional functions have been incorporated into portable communication devices to such an extent that various functions, which were conducted using a computer in the past, are frequently conducted using a portable communication device, and data services for transmitting/receiving data between a portable communication device and a computer by interconnecting them with a computer or the like with a cable or wirelessly are actively provided.

In addition, it is possible to edit data in a portable communication device by interconnecting a computer with the portable communication device as described above. For this purpose, bidirectional data communication is required between the portable communication device and the computer, wherein such data communication is conducted through a series port cable, or a USB port cable, or other type of cable.

Therefore, it is possible for a portable communication device to conduct data input or output using a USB.

Such a portable communication device is provided with a USB connector for connecting a USB, and since the portable communication device is typically very small, a micro USB connector is typically applied to such a portable communication device.

As shown in FIGS. 1 and 2, a conventional USB connector 1 includes a connector housing 2, a connector mold 3 having connection terminals (not shown) and provided in the connector housing 2, mounting terminals 5 extending from the connection terminals through the connector mold 3 and protruding backward; and insertion soldering bars 7 formed on the connector housing 2. The insertion soldering bars 7 are inserted and soldered in such that they are electrically connected to connection parts 6*a* formed on a substrate 6 mounted within a portable communication terminal (not shown).

However, the insertion soldering bars of the conventional USB connector are formed by cutting and bending the connector housing 2 inwardly, so that they are connected to the substrate by being inserted. As a result, when mounting or separating a plug connector, the insertion soldering bars are shaken by the forces applied forwardly or backwardly, which may cause the bars to come undone and to be readily fractured. Consequently, a defect rate is very high in the final resultant products, and the reliability of the products is deteriorated.

In addition, the insertion soldering bars of a conventional USB connector shown in FIG. 3 are bent either vertically or horizontally to the inside of the connector housing, and inserted into the connection parts 6*a* formed on the substrate 6, respectively. However, since the insertion soldering bars are bent in various directions and thus distribute the stresses applied to the connector, the fixing force of the final product is poor. Moreover, since the insertion soldering bars are not engaged with and supported by any reinforcement means, the fixing force of the final product is insufficient.

In order to solve the above-mentioned problems, although the prior art proposed to additionally attach a separate press to the USB connector, it is difficult to attach a small press to the connector, and the number of assembling steps is increased.

Therefore, in order to improve the reinforcement of a USB connector, what is needed are reinforcement parts which are engaged with and support insertion soldering bars arranged along the circumference of the connector housing.

SUMMARY OF THE INVENTION

Accordingly, the present invention has been made to provide a USB connector which includes one or more soldering parts around the circumference of the connector housing so as to improve the reinforcement force of the USB connector in the final product, thereby preventing the USB connector from coming undone and being fractured, whereby the defect rate of the final products can be reduced.

In addition, the present invention provides a USB connector, wherein the USB connector includes one or more reinforcement parts that are arranged around the circumference of the connector housing in such a manner that the reinforcement parts are engaged with the soldering parts arranged around the circumference of the connector housing, thereby improving the reinforcement force of the USB connector in the final product.

In addition, the present invention provides a USB connector, wherein an end of each of the soldering parts arranged around the circumference of the connector housing is formed with a soldering reinforcing groove so that the soldering strength is reinforced in the final product.

In addition, the present invention provides a USB connector, wherein the connector housing has an auxiliary reinforcement part formed at the center thereof, and the auxiliary reinforcement part is formed by cutting and bending two areas adjacent to the center of the connector, and forging the two areas to come into close contact with each other, thereby supporting the reinforcement of the connector housing.

In accordance with an exemplary aspect of the present invention, there is provided a USB connector, including: a connector housing; one or more soldering parts formed by cutting and unfolding predetermined areas around the circumference of the connector housing; and one or more reinforcement parts, each of which is formed by bending an end of the connector housing, the reinforcement parts being engaged with the soldering parts to support and reinforce the soldering parts, respectively.

BRIEF DESCRIPTION OF THE DRAWINGS

The above and other exemplary aspects, features and advantages of the present invention will become more apparent from the following detailed description taken in conjunction with the accompanying drawings, in which.

DETAILED DESCRIPTION

Figure 1:
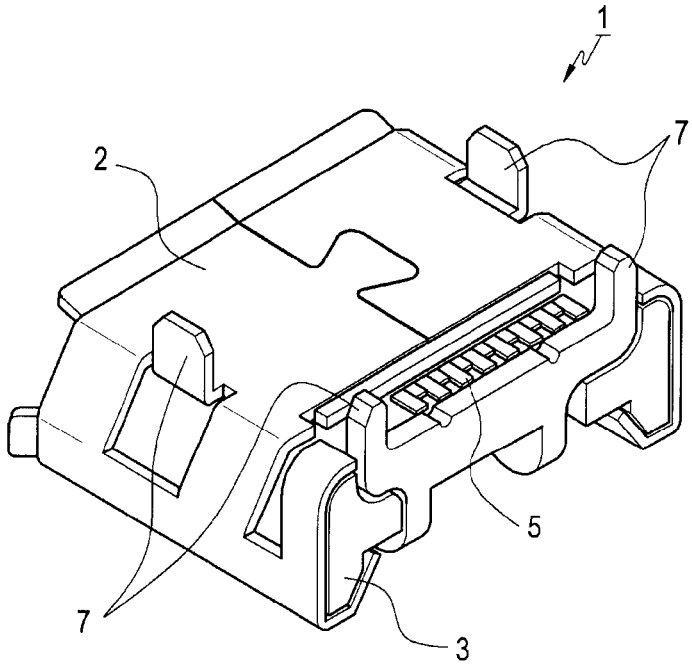
FIG.1 (PRIOR ART)
FIG. 1 is a perspective view showing a conventional USB connector for a portable communication device.
Figure 2:
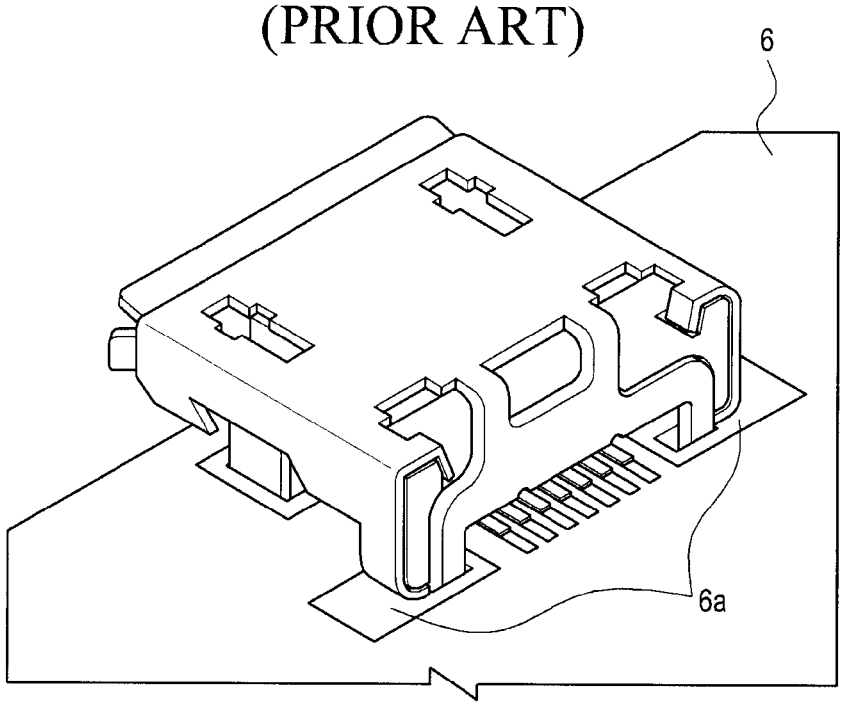
FIG.2 (PRIOR ART)
FIG. 2 is a perspective view showing the conventional USB connector used in a portable communication device.
Figure 3:
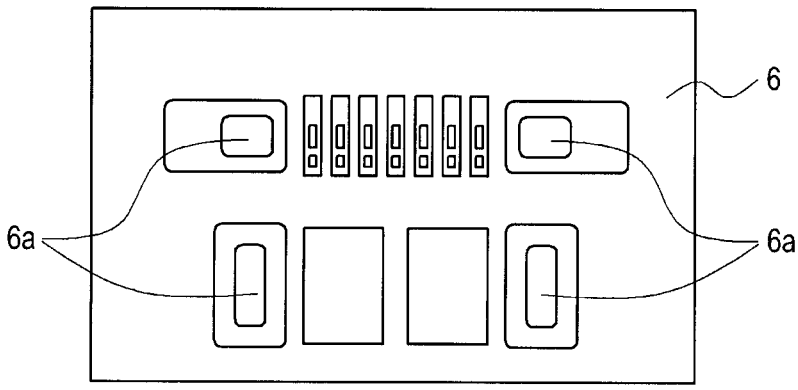
FIG.3 (PRIOR ART)
FIG. 3 is a top plan view showing connection parts formed on a substrate of a portable communication device having the conventional USB connector.

Hereinafter, exemplary embodiments of the present invention will be described with reference to the accompanying drawings. In this regard, it shall be appreciated that the exemplary embodiments described herein and the constructions shown in the accompanying drawings merely illustrate the most desired exemplary embodiments of the present invention, and various modified exemplary embodiments can be made within the spirit and scope of the presently claimed invention.

As shown in FIGS. 4 to 7, a USB connector 10 for a portable communication device (not shown) includes a connector housing 20, one or more soldering parts 30, and one or more reinforcement parts 40, and the connector housing 20 may be formed a metallic material so as to form the soldering parts 30. The connector housing 20 may be formed from other materials than the metallic material, and the metallic material include, for example, an alloy.

As shown in FIGS. 4 to 7, the soldering parts 30 are arranged around the circumference of the connector housing 20 to be soldered to the substrate 6 mounted within a portable communication device, wherein the soldering parts 30 are formed by cutting the connector housing 20 and unfolding the cut parts. In addition, each of the reinforcement parts 40 is arranged at an end of the connector housing 30, wherein the reinforcement parts 40 are bent to be engaged with the soldering parts 30, respectively, so that the reinforcement parts 40 support and reinforce the soldering parts 30.

Figure 4:
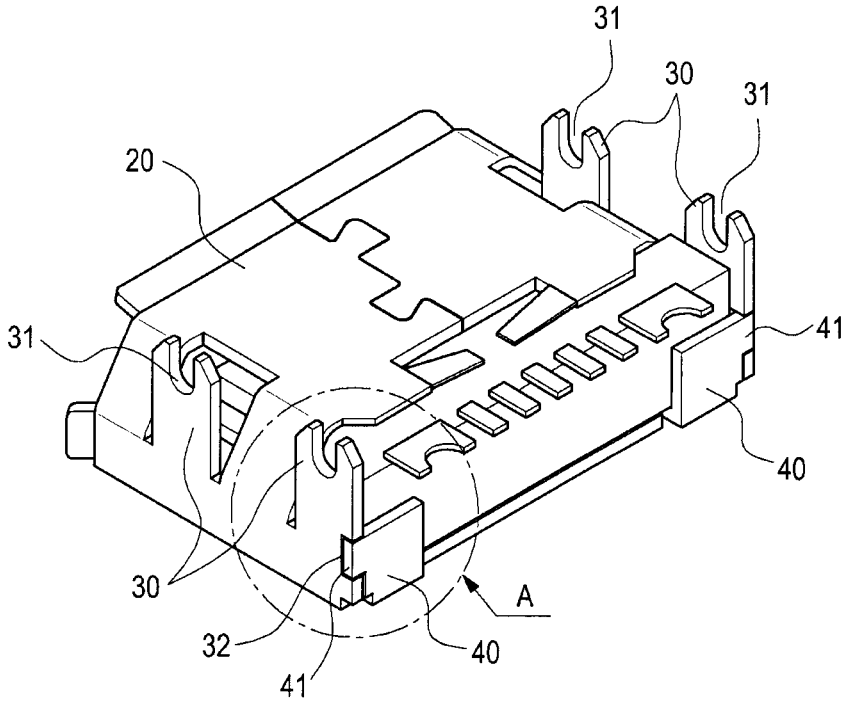
FIG. 4 is a perspective view showing a USB connector for a portable communication device in accordance with an exemplary embodiment of the present invention.

Referring now to FIG. 4, each of the soldering parts 30 and the reinforcement parts 40 is formed in a straight bar type extending from the connector housing 20. Although in the present embodiment, four soldering parts 30 are formed, it is possible to provide four or more soldering parts.

As shown in FIGS. 4 to 7, an end of each of the soldering parts 30 is formed with a soldering reinforcement groove 31 so as to reinforce soldering strength. In addition, each of the soldering parts 30 is formed with a coupling groove 32, and each of the reinforcement parts 40 is formed with protrusions, so that the protrusions 41 are fitted in the respective coupling grooves 32.

The soldering parts 30 are arranged around the circumference of the connector housing 20 in the same orientation.

In addition, the thickness of the substrate 6 of the portable communication device is preferably in the range of about 0.8 T to 1.0 T. However, the thickness may be beyond the above range.

Figure 8:
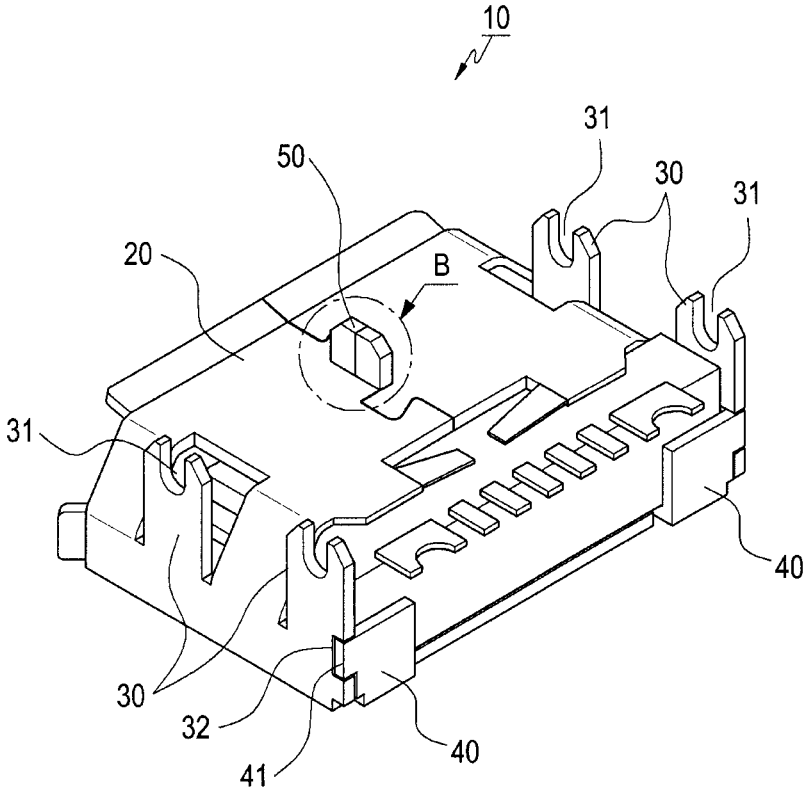
FIG. 8 is a perspective view showing auxiliary reinforcement means of a USB connector for a portable communication device in accordance with an exemplary embodiment of the present invention.
Figure 9:
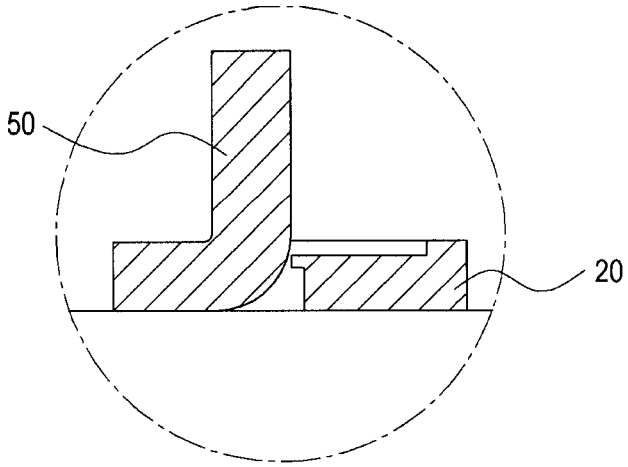
FIG. 9 is an enlarged cross-sectional view of a part "B" in FIG. 8.

FIGS. 8 and 9 show a USB connector 10 in accordance with another exemplary embodiment of the present invention, which has an auxiliary reinforcement part 50 formed at the center of the connector housing 20. The auxiliary reinforcement part 50 is formed by cutting and bending two areas adjacent to the center of the connector, and forging the two areas to come into close contact with each other, thereby supporting the reinforcement of the connector housing 20.

Meanwhile, the USB connector in accordance with the present invention may be typically applied to a portable communication device. However, besides such a portable communication device, the USB connector is applicable to various types of terminals (for example, a folder-type terminal, a sliding-type terminal or the like), or any type of device, preferably portable, that utilizes USB.

In addition to all types of mobile communication terminals operated by communication protocols in correspondence to various communication systems, examples of portable communication devices, to which the present invention is applicable, may include all kinds of information communication appliances, multimedia appliances and their applications, such as digital cameras, PMPs (Portable Multimedia players), MP3 players, navigation units, game machines, notebook personal computers, sign boards, TV sets, digital broadcasting players, PDAs (Personal Digital Assistants), and smart phones, just to name a few of the non-limiting possibilities.

A process for fabricating the inventive USB connector configured as described above will now be described in more detail with reference to FIGS. 4 to 9.

As shown in FIGS. 4 to 7, the inventive USB connector 10 for a portable communication device (not shown) includes a connector housing 20, one or more soldering parts 30, and one or more reinforcement parts 40.

Figure 5:
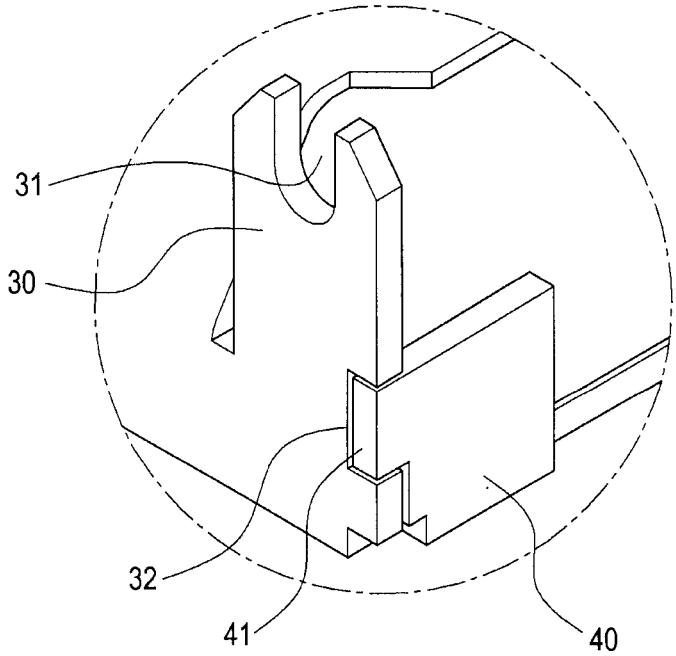
FIG. 5 is an enlarged perspective view of a part "A" in FIG. 4.

As shown in FIGS. 4 and 5, in order to form (in this example) four soldering parts 30, corresponding areas around the circumference of the connector housing 20 are cut and unfolded. Each of the four soldering parts 30 is formed in a bar type to be extended from the connector housing 20. Among the four soldering parts 30, two soldering parts 30 are engaged with the reinforcement parts 40 formed at the ends of the connector housing 20, respectively.

The protrusions 41 formed on the reinforcement parts 40 are fitted in the coupling grooves 32 formed on the two soldering parts 30, respectively, so that the reinforcement parts 40 support and reinforce the soldering parts 30.

Figure 6:
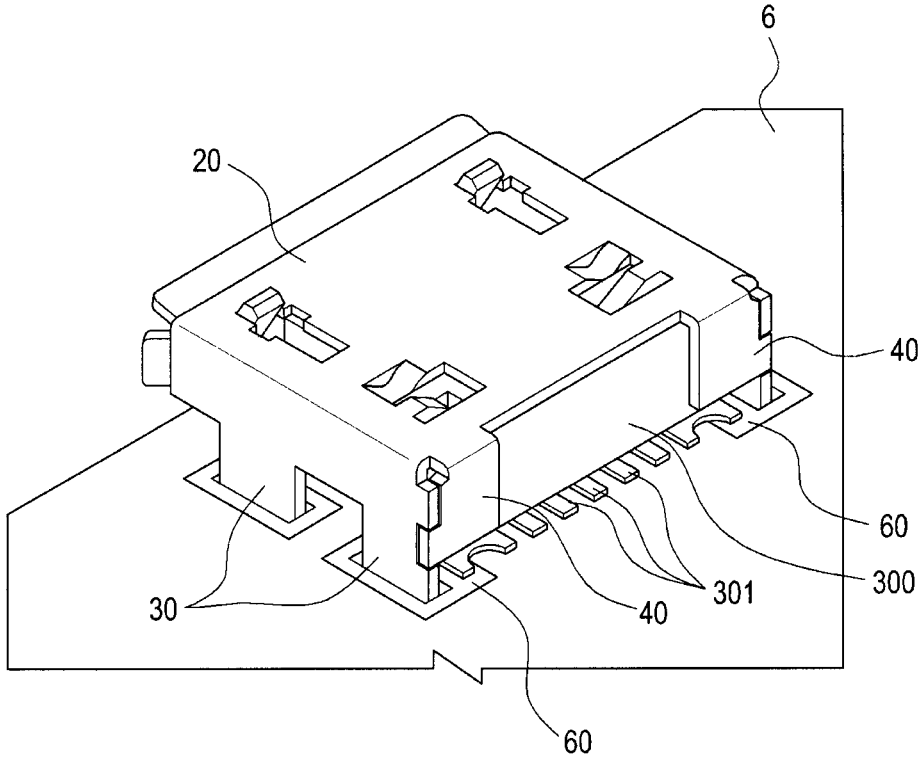
FIG. 6 is a perspective view showing the inventive USB connector used in a portable communication device.
Figure 7:
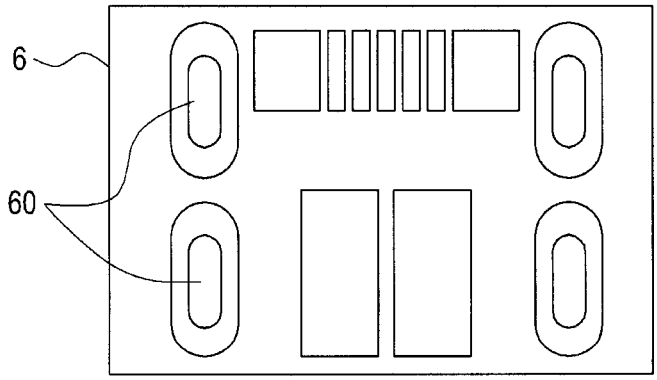
FIG. 7 is a perspective view showing connection parts formed on a substrate of a portable communication device having the inventive USB connector.

Referring to FIG. 6, the connector housing 20 encloses a connector mold 300 having connection terminals (not shown), and mounting terminals 301.

As shown in FIGS. 4 to 7, the soldering parts 30 are arranged along the circumference of the connector housing 20 in the same orientation. In this state, the soldering parts 30 are inserted into and soldered to the connection parts 60 of the substrate 6, respectively, wherein the substrate 6 is mounted within the portable communication device (not shown).

Referring to FIG. 8, the USB connector 10 soldered to the substrate 6 is supported by the circumference of the connector housing 20 and the reinforcement parts 40, whereby it is possible to prevent the USB connector from coming undone and being fractured, thereby lowering the defect rate of the final products, and improving the reliability of the final products.

Referring now to FIGS. 8 and 9, which show a USB connector 10 in accordance with another exemplary embodiment of the present invention, the inventive USB connector 10 may have an auxiliary reinforcement part 50 formed at the center of the connector housing 20, wherein the auxiliary reinforcement part 50 is formed by cutting and bending two areas adjacent to the center of the connector, and forging the two areas to come into close contact with each other, thereby supporting the reinforcement of the connector housing 20. As a result, the USB connector 10 can be further reinforced by the auxiliary reinforcement part 50, apart from being reinforced by the soldering parts 30 and the reinforcement parts 40 arranged along the circumference of the connector housing 20, whereby the connection strength and fixing force in the final products can be further improved, and flux and solder can be prevented from overflowing while the products are being fabricated.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A Universal Serial Bus (USB) connector, comprising:

a connector housing;

one or more soldering parts extending from the connector housing; and one or more reinforcement parts being formed with a protrusion to engage with a coupling groove in the unattached lateral edge of said at least one of the one or more soldering parts to increase a reinforcement force of the one or more soldering parts of the USB connector when soldered to the mounting surface of the substrate.

2. The USB connector as claimed in claim 1, wherein the one or more soldering parts are formed by cutting and unfolding predetermined areas around the circumference of the connector housing; and wherein each of the one or more reinforcement parts is formed by bending an end of the connector housing.

3. The USB connector as claimed in claim 2, wherein each of the soldering parts and reinforcement parts is formed in a bar type.

4. The USB connector as claimed in claim 2, wherein an end of each of the soldering parts is formed with a soldering reinforcing groove to form a dummy pin.

5. The USB connector as claimed in claim 2, wherein the soldering parts are arranged along the circumference of the connector housing in a same orientation.

6. The USB connector as claimed in claim 2, wherein the connector housing further comprises an auxiliary reinforcement part formed at a center thereof.

7. The USB connector as claimed in claim 6, wherein the auxiliary reinforcement part is formed by cutting and bending two areas adjacent to the center of the connector, and forging the two areas to come into close contact with each other, thereby supporting the reinforcement of the connector housing.

8. A Universal Serial Bus (USB) connector for an electronic appliance, comprising:

a connector housing;

a plurality of soldering parts extending from the connector housing; and one or more reinforcement parts being formed with a protrusion to engage with a coupling groove in the unattached lateral edge of said at least one of the one or more soldering parts to respectively engage with the one or more soldering parts and increase a reinforcement force of the one or more soldering parts of the USB connector when soldered to the mounting surface of the substrate;

wherein the USB connector is soldered to a substrate of the electronic appliance and is supported by the circumference of the connector housing and the reinforcement parts.

9. The USB connector for an electronic appliance as claimed in claim 8, wherein the soldering parts are arranged along the circumference of the connector housing in the same orientation, and wherein the soldering parts are arranged in and soldered to a plurality of connection parts of the substrate, respectively, wherein the substrate is mounted within the electronic appliance.

10. The USB connector for an electronic appliance as claimed in claim 8, wherein said one or more soldering parts are formed by cutting and unfolding predetermined areas around the circumference of the connector housing; and each of said one or more reinforcement parts is formed by bending an end of the connector housing.

11. The USB connector for an electronic appliance as recited in claim 8, wherein said electronic appliance comprises one of a folder-type terminal, or a sliding-type terminal.

12. The USB connector for an electronic appliance as recited in claim 8, wherein said electronic appliance comprises a multimedia device.

13. The USB connector for an electronic appliance as recited in claim 8, wherein the electronic appliance is selected from the group consisting of digital cameras, portable MP3 players, navigation units, game machines, notebook personal computers, sign boards, TV sets, digital broadcasting players, Personal Digital Assistants, and smart phones.

14. A method of manufacturing a Universal Serial Bus (USB) connector, comprising:

providing a connector housing;

forming a plurality of soldering parts by cutting and unfolding predetermined areas around the circumference of the connector housing; and forming a plurality of reinforcement parts that engage with a protrusion to engage with a coupling groove in the unattached lateral edge of the soldering parts to respectively engage with the one or more soldering parts and increase a reinforcement force of the one or more soldering parts of the USB connector when soldered to the mounting surface of the substrate, wherein each of the reinforcement parts is formed by bending an end of the connector housing to engage with a respective soldering part.

* * * * *